United States Patent [19]

Sato et al.

[11] Patent Number: 5,053,738

[45] Date of Patent: Oct. 1, 1991

[54] MAGNETIC LEAKAGE TRANSFORMER

[75] Inventors: Fumihiko Sato, Shizuoka; Shigesada Suzuki, Fuji, both of Japan

[73] Assignee: Tokyo Electric Co., Ltd., Tokyo, Japan

[21] Appl. No.: 617,190

[22] Filed: Nov. 23, 1990

[30] Foreign Application Priority Data

Nov. 27, 1989 [JP] Japan ..... 1-307331

[51] Int. Cl.[5] ..... H01F 21/08; H01F 27/24

[52] U.S. Cl. ..... 336/165; 336/178; 336/212; 336/215

[58] Field of Search ..... 336/155, 160, 165, 178, 336/212, 215, 233, 214

[56] References Cited

U.S. PATENT DOCUMENTS

| | | | |
|---|---|---|---|
| 1,777,256 | 9/1930 | Daley et al. | 336/165 |
| 2,553,596 | 5/1951 | Mann | 336/165 |
| 4,613,841 | 9/1986 | Roberts | 336/165 |

FOREIGN PATENT DOCUMENTS

| | | |
|---|---|---|
| 888429 | 7/1949 | Fed. Rep. of Germany . |
| 63-164411 | 7/1988 | Japan . |

*Primary Examiner*—Thomas J. Kozma

*Attorney, Agent, or Firm*—Frishauf, Holtz, Goodman & Woodward

[57] ABSTRACT

A magnetic leakage transformer includes a paired cores each having five straight legs extending in the same direction from a common back beam, and associated with each other so that the leg's ends are opposed to each other with magnetic gaps between the paired central legs and between the two paired magnetic leakage flux legs neighboring at the both sides of the central legs. The opposed two paired five legs produces a paired inner passages into which a first winding unit is inserted and a paired outer passages into which a second one is inserted.

7 Claims, 3 Drawing Sheets

MAGNETIC LEAKAGE TRANSFORMER

BACKGROUND OF THE INVENTION

1. Field of the Invention

The present invention relates to a magnetic leakage transformer.

2. Description of the Related Art

A magnetic leakage transformer is used, for example, in a discharge lamp operating device used to operate a discharge lamp such as a fluorescent lamp. The magnetic leakage transformer is used in the device not only to generate a high voltage necessary to light a discharge lamp but also to limit a discharge current to be supplied to the discharge lamp as a current-limit inductance while the discharge lamp is operating.

If a nonmagnetic leakage transformer is used instead of the magnetic leakage transformer in the discharge lamp operating device, a choke coil to be used as a current-limit inductance must be associated with the nonmagnetic leakage transformer. In this case, the construction of the circuit of the discharge lamp operating device is complicated, the number of components of the discharge lamp operating device is increased so that its assembling is complicated, and the entire discharge lamp operating device is increased in size.

FIG. 1 schematically shows a conventional magnetic leakage transformer used in a discharge lamp operating device. The conventional magnetic leakage transformer has, as shown in FIG. 2, a core unit 14 in which a pair of cores 10, 12 each having E-shaped plane are combined in a state that extending ends of three legs 10*a*, 10*b*, 10*c* and 12*a*, 12*b*, 12*c* are opposed. A pair of central legs 10*a*, 102*a* of a pair of the cores 10, 12 of the core unit 14 are covered with a primary winding spool 16*a* and a secondary winding spool 18*a*, and a primary winding 16*b* and a secondary winding 18*b*, both of which are consisted of an insulated wire, are respectively wound on the primary and secondary winding spools 16*a* and 18*a*. The primary winding spool 16*a* and the primary winding 16*b* constitute a primary winding unit 16, and the secondary winding spool 18*a* and the secondary winding 18*b* constitute a secondary winding unit 18. The primary and secondary winding spools 16*a* and 18*a* respectively have supporting bases 16*c* and 18*c* extending along the lower surfaces of a pair of the corresponding cores 10 and 12, and the above-described conventional magnetic leakage transformer is mounted at a predetermined position on a circuit board of a discharge lamp operating device through the bases 16*c* and 18*c*.

In the above-mentioned conventional magnetic leakage transformer, a pair of side legs 10*b* and 10*c* of the three legs 10*a*, 10*b*, 10*c* of one core 10 have the same length, and a pair of side legs of the three legs 12*a*, 12*b*, 12*c* of the other core 12 also have the same length. The central legs 10*a* and 12*a* are shorter than the pair of side legs 10*b*, 10*c* or 12*b*, 12*c* disposed at both sides thereof. As shown in FIG. 1, a pair of the side legs 10*b*, 10*c* and 12*b*, 12*c* of a pair of the cores 10, 12 are abutted at their extending ends against each other in a state that the pair of cores 10, 12 are associated with each other as described above, and a magnetic leakage gap "G" is created between the extending ends of the central legs 10*a* and 12*a*.

When a current is supplied to the primary winding 16*b* of the conventional magnetic leakage transformer construc[illegible] as described above, a magnetic flux directed from the central leg 10*a* of one core 10 corresponding to the primary winding 16*b* to the central leg 12*a* of the other core 12 corresponding to the secondary winding 18*b* is generated in the core unit 14, and this magnetic flux is passed through a magnetic passage returned to the central leg 10*a* of the one core 10 through the pair of side legs 12*b*, 12*c* of the other core 12 and the pair of side legs 10*b*, 10*c* of the one core 10. A current having a predetermined relationship to the current supplied to the primary winding 16*b* is generated in the secondary winding 18*b* by the magnetic flux. A magnetic resistance generated in the magnetic leakage gap "G" between the central legs 10*a* and 12*a* of the pair of cores 10 and 12 constitutes a leakage inductance for limiting a discharge current while the discharge lamp connected to the secondary winding 18*b* is operated.

The transmission efficiency of magnetic energy to be transmitted from the primary winding 16*b* to the secondary winding 18*b* in the above-described conventional magnetic leakage transformer is determined by the interlinkaging number of exciting magnetic fluxes generated by the primary winding 16*b* to the secondary winding 18*b*. Thus, the lesser the magnetic resistance in the magnetic circuit is and the higher the permeability of the core unit 14 is, the higher the transmission efficiency of the magnetic energy becomes and hence the reduction in size of the transformer can be promoted.

However, in the above-mentioned conventional magnetic leakage transformer, the magnetic leakage gap "G" increases the magnetic resistance. The magnetic leakage gap "G" is necessarily indispensable to prevent magnetic saturation of the above-described conventional magnetic leakage transformer in an inverter operation, but the size of the gap "G" required therefor is smaller than that of the gap "G" necessary to obtain the leakage inductance.

In order to obtain a desired discharge starting voltage for starting the operation of the discharge lamp by compensating a large decrease in the transmission efficiency of magnetic energy generated by the large gap "G" necessary to obtain a leakage inductance, in the above described conventional magnetic leakage transformer the numbers of turns of the primary and secondary windings 16*b* and 18*b* are larger than those in the above described conventional magnetic leakage transformer. Accordingly, the primary and secondary winding units 16 and 18 are large in size, and hence the entire magnetic leakage transformer is large in size and weight.

In order to obtain a desired discharge lamp starting voltage by the above-mentioned conventional magnetic leakage transformer having large magnetic resistance, the value of the exciting current to be supplied to the primary winding 16*b* must be increased as compared with that of the nonmagnetic leakage transformer.

SUMMARY OF THE INVENTION

Accordingly, it is an object of the present invention to provide a magnetic leakage transformer which can be not only reduced in size and weight but decreased in an input value necessary to obtain a desired output as compared with that of a conventional transformer.

In order to achieve the above-described object, a magnetic leakage transformer according to the present invention comprises: a core unit including a pair of cores each having a central leg, a pair of coupling arms extending from the central leg to both sides thereof, side legs extending in the same direction as the central leg at positions isolated from the central leg at the pair of coupling arms, and magnetic flux leakage legs extending in the same direction as the side legs and the central leg between the side legs and the central leg at the pair of coupling arms in a state isolated therefrom, the pair of cores being disposed in a state that the central legs, two pairs of side legs and two pairs of magnetic flux leakage legs are opposed to each other at their extending ends, and the extending ends of the paired side legs of one core are abutted against those of the paired side legs of the other core, and the paired cores are associated with each other so that magnetic gaps are generated between the extending end of the central leg of the one core and that of the other core and between the extending ends of the paired magnetic flux leakage legs of one core and those of the other core; a first winding unit inserted into a pair of inner passages created between the pair of central legs of the pair of cores of the core unit and two pairs of magnetic flux leakage legs disposed at both sides of the central legs so that the first winding unit surrounds the pair of central legs; and a second winding unit inserted into a pair of outer passages created between the two pairs of the magnetic flux leakage legs of the core unit and the two pairs of side legs disposed outside the magnetic flux leakage legs so that the second winding unit surrounds the first winding unit.

In the magnetic leakage transformer of the present invention characterized by being constructed as described above, a magnetic flux is generated in the pair of central legs of the pair of cores of the core unit when a current is supplied to the first winding unit, thereby circulating the magnetic flux to the above-described central legs through the pair of coupling arms of one core, the pair of side legs, the pair of side legs of the other core, and the pair of coupling arms.

In the first magnetic circuit, the pair of central legs are magnetic flux generating portions which are almost irrespective to the magnetic resistance, and the magnetic resistance generated at the abutting portions of the extending ends of the pair of side legs of the one core and those of the other core is extremely small.

The current generated in the other winding unit by the magnetic flux passing the first magnetic circuit generates magnetic fluxes directed in opposite direction to those in the first magnetic circuit in the one second magnetic circuit composed of the one magnetic flux leakage leg of the one core, one coupling arm, the one side leg, one side leg of the other core, one coupling arm and one magnetic flux leakage leg, and the other magnetic circuit composed of the other magnetic flux leakage leg of the one core, the other coupling arm, the other side leg, the other side leg of the one core, the other coupling arm and the other magnetic flux leakage leg. The magnetic gap between the extending ends of the pair of magnetic flux leakage legs of the one core and the extending ends of the pair of magnetic flux leakage legs of the other core of the one and the other second magnetic circuits provides leakage inductance.

Since the magnetic gap for providing the leakage inductance is not contained in the first magnetic circuit, magnetic energy transmission efficiency between the first and second winding units is not lowered by the magnetic resistance generated by the magnetic gap.

Since the magnetic passage length of the one and the other second magnetic circuits is much smaller than that of the first magnetic circuit, an ampere-turn for generating the leakage inductance is increased, thereby improving the efficiency of generating the leakage inductance.

Therefore, the first and second winding units can be reduced in size and weight (and hence the magnetic leakage transformer can be reduced in size and weight), and the input value necessary to obtain a desired output can be reduced as compared with that of the conventional magnetic leakage transformer.

The second winding unit disposed in the core unit to further surround the first winding unit surrounding the pair of central legs of the pair of cores of the core unit reduces the height of the magnetic leakage transformer and hence decreases the thickness of the magnetic leakage transformer.

In the magnetic leakage transformer of the present invention characterized by being constructed as described above, it is preferable that the first winding unit and the second winding unit are coaxially disposed to each other in the same horizontal plane.

Such arrangement of the first and second winding units further decreases the height of the magnetic leakage transformer and hence further promote the reduction in height of the magnetic leakage transformer.

In the magnetic leakage transformer of the present invention characterized by being constructed as described above, the magnetic gaps between the extending ends of the central legs of one core of the core unit and the extending ends of the pair of magnetic flux leakage legs of one core and those of the other core are preferably composed of a space.

The magnetic gap Composed of the space is simply manufactured in comparison with a magnetic gap composed of a spacer of a non-magnetic material, and a magnetic gap composed of a dent formed in a portion of an extending end surface described above and an opening formed in a portion of an extending portion including the extending end surface. Since the magnetic gaps, between the two pairs of magnetic flux leakage legs of the pair of cores, for providing leakage inductance are independent from the magnetic gap, provided between the extending ends of the pair of central legs of the pair of cores, for preventing magnetic saturation, it is easy to adjust the former magnetic gap to obtain a desired leakage inductance.

In the magnetic leakage transformer of the present invention characterized by being constructed as described above, it is preferable that the pair of cores of the core unit are made of ferrite. The paired cores of ferrite improve the operating efficiency of the magnetic leakage transformer of the present invention.

In the magnetic leakage transformer of the present invention characterized by being constructed as described above, it is preferable that the first winding unit and the second winding unit include a first winding and a second winding, respectively, and each of the first and second windings is an insulated wire composed by twisting a plurality of extrafine wires with insulation coating films.

Such twisted insulated wire decreases the number of turns in each of the first and second windings of the first and second winding units, and improves the degree of heat discharge in the first and second winding units. Therefore, the reduction in size and height of each of the first and second winding units, and hence those of the magnetic leakage transformer of this invention is promoted.

In the magnetic leakage transformer of the present invention characterized by being constructed as described above, it is preferable that the magnetic gap between the extending end of the central leg of the one core of the core unit and that of the other core is set smaller than the magnetic gaps between the extending ends of the pair of magnetic flux leakage legs of the one core and those of the other core.

In this case, the former magnetic gap functions to only prevent magnetic saturation in the above-described first magnetic circuit, and the magnetic energy transmission efficiency from the first winding unit to the second winding unit is not disturbed. Since the latter magnetic gaps are irrespective of the first magnetic circuit for preventing the magnetic saturation of the one and the other second magnetic circuits, the latter magnetic gaps can be adjusted to prevent the magnetic saturation in the one and the other second magnetic circuits and to obtain a desired leakage inductance. Therefore, the magnetic leakage transformer of the present invention can function most preferably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

Brief Description of the Drawings

The accompanying drawings, which are incorporated in and constitute a part of the specification, illustrate a presently preferred embodiment of the invention, and together with the general description given above and the detailed description of the preferred embodiment given below, serve to explain the principles of the invention.

An embodiment of the present invention will now be described in detail with reference to FIGS. 3 to 5.

DETAILED DESCRIPTION OF THE PREFERRED EMBODIMENTS

Figure 3:
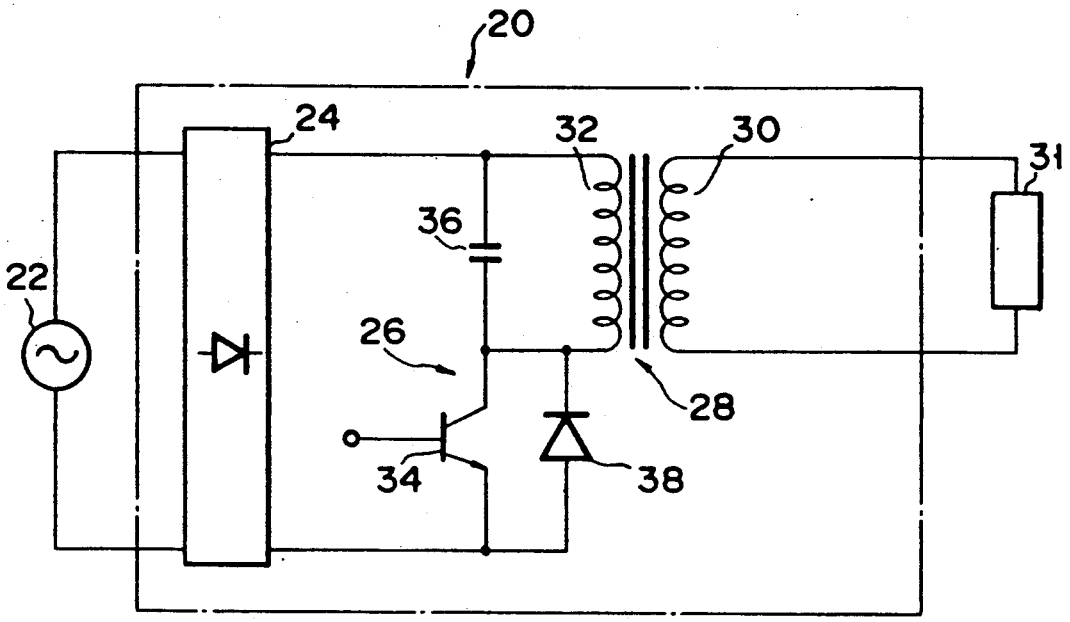
FIG. 3 is a view schematically showing an electric circuit of a discharge lamp operating device using a magnetic leakage transformer and used to operate a discharge lamp such as a fluorescent lamp.

FIG. 3 schematically shows an electric circuit of a discharge lamp operating device 20 using a magnetic leakage transformer and used to operate a discharge lamp such as a fluorescent lamp.

The discharge lamp operating device 20 has a DC power source circuit 24 connected to a commercial AC power source 22, and an inverter circuit 26 connected to the output terminal of the DC power source 24. The inverter circuit 26 has a magnetic leakage transformer 28 according to an embodiment of the present invention. A discharge lamp 31 such as a fluorescent lamp is connected to a secondary winding 30 of the magnetic leakage transformer 28 and the secondary winding 30 is consisted of an insulated wire. One terminal of a primary winding 32 of the magnetic leakage transformer 28 is connected to one terminal of the DC power source 24, and the other terminal of the primary winding 32 is connected to the collector of a switching transistor 34. The primary winding 32 is also consisted of the insulated wire. A capacitor 36 is connected between the collector of the switching transistor 34 and one terminal of the DC power source 24. The emitter of the switching transistor 34 is connected to the other terminal of the DC power source 24, and the base is connected to a control circuit (not shown). A diode 38 for protecting the switching transistor 34 is connected between the collector and the emitter of the switching transistor 34.

When the base of the switching transistor 34 is turned ON and OFF in the inverter circuit 26 as described above, a resonance circuit composed of the capacitor 36 and the primary winding 32 of the magnetic leakage transformer 28 is resonated, and therefore a predetermined operating voltage for the discharge lamp 31 is supplied from the secondary winding 30 of the magnetic leakage transformer 28 to the discharge lamp 31.

Figure 4:
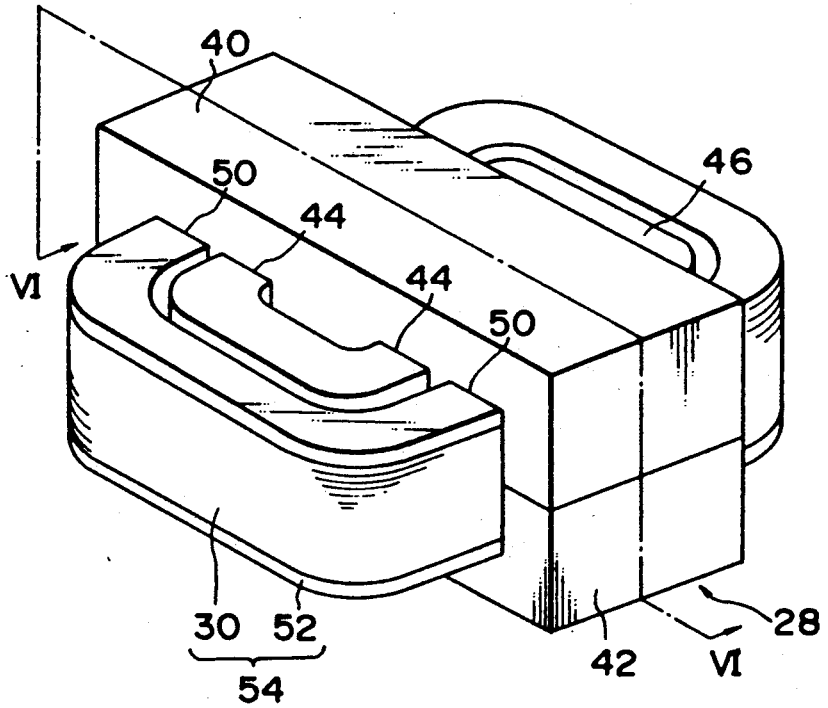
FIG. 4 is a schematic perspective view of a magnetic leakage transformer of the present invention instead of the above-described conventional magnetic leakage transformer.

FIG. 4 schematically shows an external appearance of the magnetic leakage transformer 28 according to an embodiment of the present invention used in the abovedescribed discharge lamp operating device 20.

The core unit of this embodiment is composed of a pair of upper and lower cores 40 and 42 made of ferrite. Each of cores 40 and 42 has, as shown in FIG. 5, a central leg 40*a* or 42*a*, a pair of coupling arms 40*b* or 42*b* extending from the central leg 40*a* or 42*a* to the both sides thereof, side legs 40*c* or 42*c* extending in the same direction as that of the central leg 40*a* or 42*a* at positions isolated from the central leg 40*a* or 42*a* on the paired coupling arms 40*b* or 42*b*, and magnetic flux leakage legs 40*d* or 42*d* extending from the paired coupling arms 40*b* or 42*b* in the same direction as those of the paired side arms 40*c* or 42*c* and the central leg 40*a* or 42*a* between the side legs 40*c* or 42*c* and the central leg 40*a* or 42*a* in the state isolated therefrom.

The pair of upper and lower cores 40 and 42 are associated in a state that the central legs 40*a* and 42*b*, the pair of side legs 40*c* and 42*c*, and the pair of magnetic flux leakage legs 40*d* and 42*d* are opposed at their extended ends.

The extending length of each of the paired side legs 40*c* and 42*c* of the paired cores 40 and 42 are longer than that of each of the central legs 40*a* and 42*a*, and longer than that of each of the paired magnetic flux leakage legs 40*d* and 42*d*. The extending length of each of the paired magnetic flux leakage legs 40*d* and 42*d* are shorter than that of each of the central legs 40*a* and 42*a*.

Figure 5:
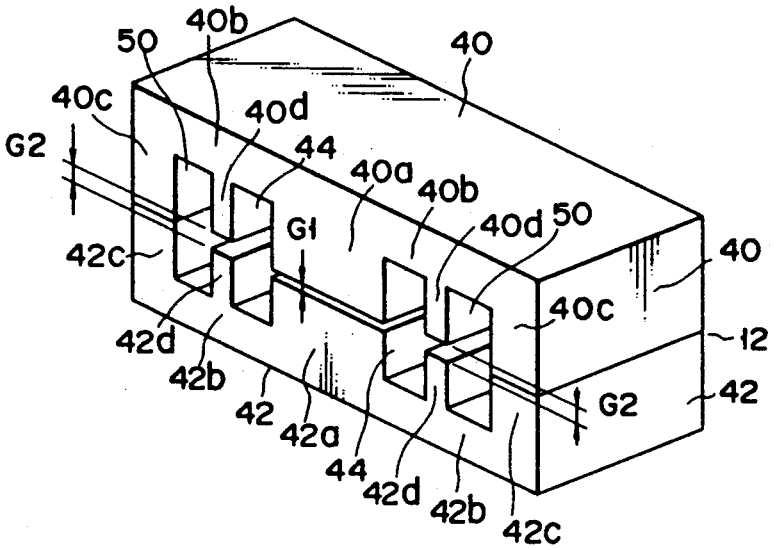
FIG. 5 is a schematic perspective view of a core unit of the magnetic leakage transformer of FIG. 4.

Accordingly, when the pair of upper and lower cores 40 and 42 are associated, as shown in FIG. 5, only the extending ends of the pair of side legs 40*c* of the upper core 40 are abutted against the extending ends of the pair of side legs 42*c* of the lower core 42, a gap G1 is created between the extending end of the central leg 40*a* of the upper core 40 and the extending end of the central leg 42*a* of the lower core 42, and a gap G2 larger than the gap G1 is created between the extending end of each of the pair of magnetic flux leakage legs 40*d* of the upper core 40 and the extending end of each of the pair of magnetic flux leakage legs 42*d* of the lower core 42.

The cross sectional area of each of the pair of magnetic flux legs 40*d* and 42*d* are smaller than that of each of the central legs 40*a* and 42*a* and each of the pair of side legs 40*c* and 42*c*. 10 A first winding unit 48, composed of a first annular primary winding spool 46 formed in a square-shaped plane as shown in FIG. 4 and a primary winding 32 wound in a predetermined number of turns on the primary winding spool 46, is inserted into a pair of inner passages 44 formed between the pair of central legs 40*a* and 42*a* of the pair of associated upper and lower cores 40 and 42 and two pairs of magnetic flux leakage legs 40*d* and 42*d* disposed at both sides of the central legs 40*a* and 42*a*. Thus, the primary winding 32 surrounds the pair of central legs 40*a* and 42*a* of the pair of associated upper and lower cores 40 and 42.

Figure 6:
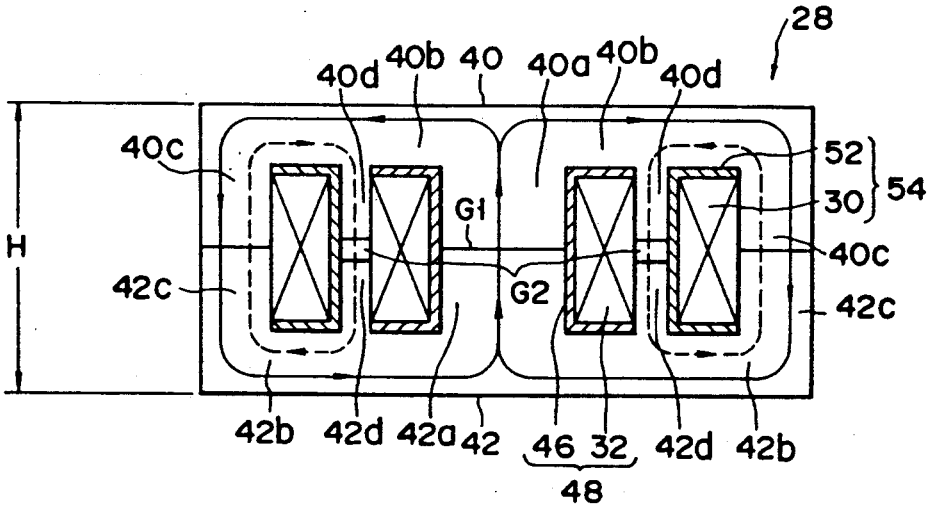
FIG. 6 is a schematic cross sectional view taken along a line VI—VI of the magnetic leakage transformer of FIG. 4, illustrating a first magnetic circuit used to transmit magnetic energy from a first winding unit to a second winding unit and a second magnetic circuit including a magnetic gap to obtain a desired leakage inductance.

The primary winding spool 46 is formed of heat resistant nonconductive resin such as glass fiber-filled nylon resin to have an angulared C shape cross section (an inverted angulared C shape cross section as seen from a reverse side) as shown in FIG. 6. Both terminals of the primary winding 32 protrude downwardly from a lower horizontal flange of the primary winding spool 46.

A second winding unit 54, composed of a secondary annular winding spool 52 formed in a square-shaped plane as shown in FIG. 4 and a secondary winding 30 wound in a predetermined number of turns on the secondary winding spool 52, is inserted into a pair of outer passages 40 formed between the two pairs of magnetic leakage legs 40*d* and 42*d* of the pair of associated upper and lower cores 40 and 42 and two pairs of side legs 40*c* and 42*c* disposed outside the magnetic flux leakage legs 40*d* and 42*d*. The inner diameter of the second winding unit 54 is larger than the outer diameter of the first winding unit 48 to surround the first winding unit 48.

The secondary winding spoor 52 has, as shown in FIG. 6, the same cross sectional shape as that of the above-described primary winding spool 46, and is formed of the same material. Both terminals of the secondary winding 30 protrude downwardly from the lower horizontal flange of the secondary winding spool 52.

In the magnetic leakage transformer 28 according to the one embodiment of the present invention and constructed as described above, an exciting current flows in the primary winding 32 of the first winding unit 48 at each time when the above-described resonance circuit shown in FIG. 3 is resonated. The primary winding 32 to which the exciting current is supplied generates an exciting magnetic flux directed toward the pair of coupling arms 40*b* of one core 40 in the pair of central legs 40*a* and 42*a* of the pair of cores 40 and 42 disposed at the center. The exciting magnetic flux is circulated to the pair of central legs 40*a* and 42*a* through the pair of side legs 40*c* of the one core 40, the pair of side legs 42*c* of the other core 42 and the pair of coupling arms 42*b* of the other core 42 as indicated by a solid line arrow in FIG. 6.

The pair of central legs 40*a* and 42*a* of the pair of cores 40 and 42 are magnetic flux generating portions in the route (first magnetic circuit) of the flow of the exciting magnetic flux indicate y a solid line arrow in FIG. 6, so that the central legs are almost irrespective of the magnetic resistance. The only position at which the magnetic resistance is generated in the first magnetic circuit is the extending ends of the two pairs of the side legs 40*c* and 42*c* of the pair of cores 40 and 42 and the extending ends were abutted against each other. However, since no air gap is substantially existed between the extending ends of the side legs 40*c* and 42*c*, a magnetic resistance generated at the extending ends is extremely small. Therefore, the magnetic energy generated by the excitation of the primary winding 32 is transmitted by substantially 100 % to the secondary winding 30.

The secondary winding 30 in which magnetic energy is transmitted from the primary winding 32 generates another magnetic flux reverse to the magnetic flux in the above-described first magnetic circuit. The another magnetic flux passes, as shown by a broken line arrow in FIG. 6, through one second magnetic circuit passing from one pair of magnetic flux leakage legs 40*d* and 42*d* of the pair of cores 40 and 42 through the one coupling arm 42*b* of the other core 42, one side arm 42C, one side arm 40C of the one core 40, and one coupling arm 40*b*, and also through the other second magnetic circuit passing from the other pair of magnetic flux leakage legs 40*d* and 42*d* through the other coupling arm 42*b* of the other core 42, the other side arm 42C, the other side arm 40C of the one core 40 and the other coupling arm 40*b*.

Magnetic leakage in the gap G2 between the extending ends of the two pairs of magnetic flux leakage legs 40*d* and 42*d* of the pair of cores 40 and 42 provides a desired current limiting leakage inductance in one or the other second magnetic circuit to limit the operating current to be discharged from the secondary winding 30 to the discharge lamp 31 (FIG. 3) to a predetermined value or less.

Since the gap G2 in the second magnetic circuit is not contained in the above-mentioned first magnetic circuit, the gap G2 does not increase the magnetic resistance of the first magnetic circuit. In other words, the gap G2 does not affect influence to the transmission efficiency of the magnetic energy from the primary winding 32 to the secondary winding 30.

Since the second magnetic circuit is shorter in the length of the magnetic path than the first magnetic circuit, an ampere-turn for generating a current limiting leakage inductance can be increased, thereby improving the efficiency of generating the current limiting leakage inductance.

Figure 1:
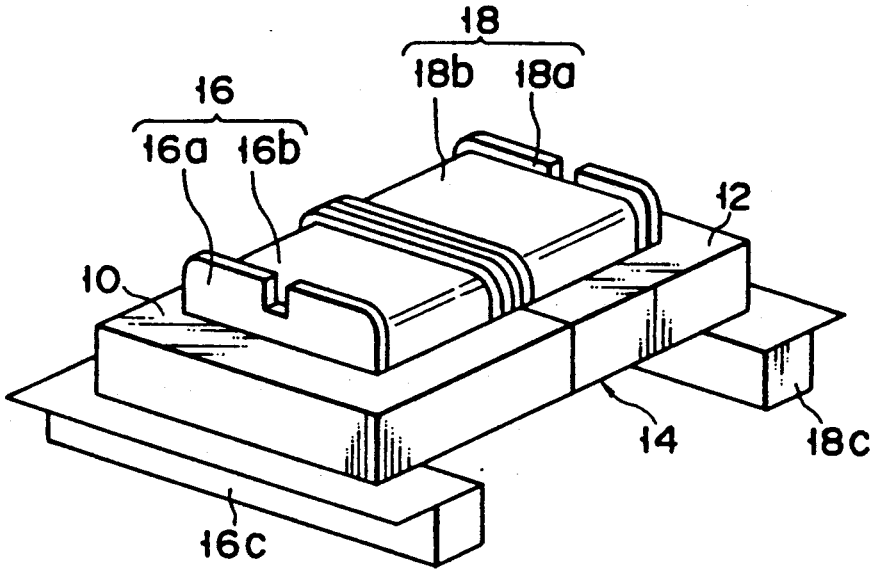
PRIOR ART FIG. 1
FIG. 1 is a perspective view schematically showing a conventional magnetic leakage transformer used in a discharge lamp operating device used to operate a discharge lamp such as a fluorescent lamp.
Figure 2:
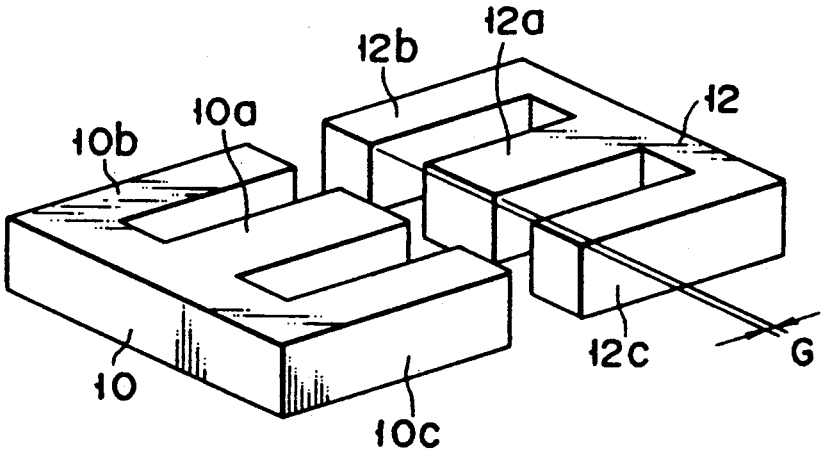
PRIOR ART FIG. 2
FIG. 2 is a schematic exploded perspective view of a core unit of the magnetic leakage transformer of FIG. 1.

The magnetic leakage transformer 28, according to one embodiment of the present invention and composed as described above, can reduce in the numbers of turns of the primary windings 32 and the secondary winding 30 required to obtain the same outputs as compared with the conventional magnetic leakage transformer shown in FIGS. 1 and 2. As a result, the profiles of the first and second winding units 48 and 52 can be reduced in size and thickness.

When the magnetic leakage transformer 28 according to the one embodiment of the present invention was used, instead of the conventional magnetic leakage transformer shown in FIGS. 1 and 2, in the discharge lamp operating device used to operate two 40 W fluorescent lamps, the number of turns of the secondary winding 30 in the magnetic leakage transformer 38 of the one embodiment could be reduced to about 60% of that of the conventional magnetic leakage transformer, and the entire weight could be decreased to about 80%.

In the magnetic leakage transformer 28 of the present invention, the gap G2 of the second magnetic circuit is not included in the above-described first magnetic circuit, and hence the gap G2 does not affect influence to the efficiency of the transmission of the magnetic energy from the primary winding 32 to the secondary winding 32 in the first magnetic circuit. Accordingly, the gap G1 in the first magnetic circuit and the gap G2 in the second magnetic circuit may be independently freely set in response to the operations desired in the corresponding primary and secondary windings 32 and 36.

More specifically, the gap G1 is set as narrow as possible so as to reduce the exciting current to be supplied to the primary winding 32 as small as possible while preventing magnetic saturation in the first magnetic circuit, and the gap G2 can be freely set in a range larger than the gap G1 in response to the magnitude of the load impedance of the discharge lamp 31.

In the magnetic leakage transformer 28 of the present invention, the first and second winding units 48 and 52 are disposed concentrically in the same plane in the horizontal direction. Thus, in comparison with the conventional magnetic leakage transformer shown in FIGS. 1 and 2 in which the first and second winding units are disposed in series concentrically in the horizontal direction, the height H of the magnetic leakage transformer 28 is lower than that of the conventional magnetic leakage transformer. Therefore, the height of the discharge lamp operating device 20 (FIG. 3) using the magnetic leakage transformer 28 of the present invention can be made thinner than that of the discharge lamp operating device 20 using the conventional magnetic leakage transformer. This satisfies a request for reduction in thickness of a lighting equipment in a recent year.

If the inverter circuit 26 used in the magnetic leakage transformer 28 of the present invention is a high frequency inverter circuit which operates with a high frequency of about 20 kHz to about 50 kHz, the numbers of turns of the primary and secondary windings 32 and 30 of the primary and secondary winding spools 46 and 52 can be reduced by employing an insulated wire, made by twisting a plurality of extrafine wires with insulating coating films, as the primary and secondary windings 32 and 30, and the magnetic leakage transformer 28 of the present invention can be further reduced in size and thickness.

The reductions in the numbers of turns of the primary and secondary windings 32 and 30 of the primary and secondary winding spools 46 and 52 improve heat radiation degrees in the first and second winding units 48 and 54, and hence further decrease in sizes and thicknesses of the first and second winding units 48 and 54 as well as of the magnetic leakage transformer 28 of the present invention.

The embodiment described above is illustrated and described for explaining the present invention, and the present invention is not limited to the above described particular embodiment. Various modifications and variations may be made within the spirit and scope of the present invention.

For example, each of a pair of cores 40 and 42 may be composed by laminating thin iron plates of the same planar shape.

The application of the magnetic leakage transformer 28 of the present invention is not limited to the discharge lamp operating device.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A magnetic leakage transformer comprising:

a core unit including a pair of cores each having a central leg, a pair of coupling arms extending from the central leg to both sides thereof, side legs extending in the same direction as the central leg at positions isolated from the central leg at the pair of coupling arms, and magnetic flux leakage legs extending in the same direction as the side legs and the central leg between the side legs and the central leg at the pair of coupling arms in a state isolated therefrom, the pair of cores being disposed in a state that the central legs, two pairs of side legs and two pairs of magnetic flux leakage legs are opposed to each other at their extending ends, and the extending ends of the paired side legs of one core are abutted against those of the paired side legs of the other core, and the paired cores are associated with each other so that magnetic gaps are generated between the extending end of the central leg of the one core and that of the other core and between the extending ends of the paired magnetic flux leakage legs of one core and those of the other core;

a first winding unit inserted into a pair of inner passages created between the pair of central legs of the pair of cores of the core unit and two pairs of magnetic flux leakage legs disposed at both sides of the central legs so that the first winding unit surrounds the pair of central legs; and a second winding unit inserted into a pair of outer passages created between the two pairs of the magnetic flux leakage legs of the core unit and the two pairs of side legs disposed outside the magnetic flux leakage legs so that the second winding unit surrounds the first winding unit.

2. A magnetic leakage transformer according to claim 1, wherein the first winding unit and the second winding unit are Coaxially disposed to each other in the same horizontal plane.

3. A magnetic leakage transformer according to claim 1, wherein the magnetic gaps between the extending end of the central leg and the extending ends of the paired magnetic flux leakage legs of one core of said core unit, and those of the other core are composed of a space.

4. A magnetic leakage transformer according to claim 1, wherein each core of the core unit is made of ferrite.

5. A magnetic leakage transformer according to claim 1, wherein the first winding unit and the second winding unit include a first winding and a second winding, respectively, and each of the first and second windings is an insulated wire composed by twisting a plurality of extrafine wires with insulation coating films.

6. A magnetic leakage transformer according to claim 1, wherein the [illegible]gnetic gap between the extending end of the central leg of one core of the core unit and that of the other core is smaller than each magnetic gap between the extending ends of the pair of magnetic flux leakage legs of one core and those of the other core.

7. A magnetic leakage transformer comprising:

a core unit including a pair of cores each having a central leg, a pair of coupling arms extending from the central leg to both sides thereof, side legs extending in the same direction as the central leg at positions isolated from the central leg at the pair of coupling arms, and magnetic flux leakage legs extending in the same direction as the side legs and the central leg between the side legs and the central leg at the pair of coupling arms in a state isolated therefrom, the pair of cores being disposed in a state that the central legs, two pairs of side legs, and two pairs of magnetic flux leakage legs are opposed to each other at their extending ends, and the extending ends of the paired side legs of one core are abutted against those of the paired side legs of the other core, and the paired cores are associated with each other so that magnetic gaps each composed of a space are generated between the extending ends of the central leg of the one the other core and between the extending ends of the paired magnetic flux leakage legs of one core and those of the other core;

a first winding unit inserted into a pair of inner passages created between the pair of central legs of the pair of cores of the core unit and two pairs of magnetic flux leakage legs disposed at both sides of the central legs so that the first winding unit surrounds the pair of central legs; and a second winding unit inserted into a pair of outer passages created between the two pairs of the magnetic flux leakage legs of the core unit and the two pairs of side legs disposed outside the magnetic flux leakage legs so that the second winding unit is coaxially disposed with the first winding unit in the same horizontal plane surrounds the first winding unit.

* * * * *